United States Patent [19]

Maciel et al.

[11] Patent Number: 4,766,680

[45] Date of Patent: Aug. 30, 1988

[54] SHOE WITH TRANSPARENT SOLE AND SCUFF PADS

[75] Inventors: Joao P. Maciel; José H. Baungratz, both of Carlos Barbosa, Brazil

[73] Assignee: Grendene S.A., Brazil

[21] Appl. No.: 946,530

[22] Filed: Dec. 23, 1986

[51] Int. Cl.[4] ..... A43B 1/14; A43B 3/12; A43B 13/12

[52] U.S. Cl. ..... 36/87; 36/11.5; 36/30 R

[58] Field of Search ..... 36/87, 11.5, 30 R, 31, 36/59 R, 59 B, DIG. 2, 8.1; D2/270, 322

[56] References Cited

U.S. PATENT DOCUMENTS

| | | | |
|---|---|---|---|
| D. 257,700 | 12/1980 | Famolare, Jr. . | |
| D. 261,946 | 11/1981 | Trask . | |
| D. 266,798 | 11/1982 | Famolare, Jr. | D2/322 |
| 879,732 | 2/1908 | Busby . | |
| 1,124,988 | 1/1915 | Witter . | |
| 1,507,844 | 9/1924 | Mason . | |
| 1,604,954 | 11/1926 | Artz . | |
| 1,777,747 | 10/1930 | De Witt . | |
| 1,789,518 | 1/1931 | De Witt . | |
| 1,821,051 | 9/1931 | Brown . | |
| 1,984,989 | 12/1934 | Reed . | |
| 2,239,206 | 4/1941 | Tietig | 36/11.5 |
| 2,303,431 | 12/1942 | Brophy . | |
| 2,381,389 | 8/1945 | Riesing . | |
| 2,518,649 | 8/1950 | Tydings et al. . | |
| 2,669,036 | 2/1954 | Israel . | |
| 2,711,033 | 6/1955 | Dick . | |
| 2,755,567 | 7/1956 | Rudine . | |
| 2,887,792 | 5/1959 | Staff . | |
| 2,889,639 | 6/1959 | Rudine . | |
| 3,017,705 | 1/1962 | Peters . | |
| 3,934,359 | 1/1976 | Fletcher . | |
| 4,333,247 | 6/1982 | Marinelli | 36/11.5 |
| 4,584,782 | 4/1986 | Thatcher | 36/11.5 |

FOREIGN PATENT DOCUMENTS

| | | | |
|---|---|---|---|
| 702447 | 2/1941 | Fed. Rep. of Germany . | |
| 3400998 | 7/1985 | Fed. Rep. of Germany | 36/11.5 |
| 870694 | 12/1941 | France . | |
| 2475369 | 8/1981 | France | 36/87 |
| 650883 | 1/1963 | Italy | 36/30 R |
| 79949 | 1/1919 | Switzerland . | |
| 179056 | 11/1935 | Switzerland . | |

*Primary Examiner*—James Kee Chi

*Attorney, Agent, or Firm*—Luedeka, Hodges & Neely

[57] ABSTRACT

The specification disclosed a plastic shoe for being worn on a human foot. The shoe includes a transparent plastic sole and an upper for securing the sole to the foot. At least one opaque scuff pad is disposed on the lower surface of the transparent sole to absorb scuffing when the sole is walked upon.

3 Claims, 3 Drawing Sheets

SHOE WITH TRANSPARENT SOLE AND SCUFF PADS

FIELD OF INVENTION

The present invention relates to the field of plastic shoes and particularly relates to a plastic shoe having a transparent bottom with opaque scuff pads disposed thereon.

It has been known to manufacture plastic shoes with transparent soles, but a prevalent objection to such shoes is scuffing. The sole of a shoe is materially scuffed by walking on it, and most of the scuffing occurs in the ball and heel area of a shoe. In a shoe with a transparent sole, much of the aesthetic appeal of the sole is lost to the wearer when the ball and heel area become scuffed and, thus, it is desirable to avoid scuffing the sole or to hide the scuffing. The present invention addresses this problem.

SUMMARY OF THE INVENTION

In order to overcome the scuffing problem discussed and to secure other advantages that will readily be appreciated by those skilled in the art, an improved plastic shoe is provided for being worn on a human foot. The shoe includes a transparent plastic sole having a lower surface and an upper surface for fitting against the sole of a human foot, and an upper is provided for securing the transparent sole to the foot. At least one opaque scuff pad is disposed on the lower surface of the transparent sole.

In the preferred embodiment, a recess is formed in the lower surface of the transparent sole and is shaped to receive the opaque scuff pad. The recess has a main surface and has side walls extending about the main surface, and the scuff pad is mounted on the main surface of the recess. The scuff pad is dimensioned to extend from the main surface of the recess beyond the side walls and beyond the lower surface of the transparent sole to absorb scuffing. Again, in the preferred embodiment, the scuff pads are located in the heel area and the ball area of the sole.

BRIEF DESCRIPTION OF THE DRAWINGS

The present invention may best be understood by reference to a Detailed Description of a preferred embodiment when considered in conjunction with the Drawings in which.

DETAILED DESCRIPTION

Figure 1:
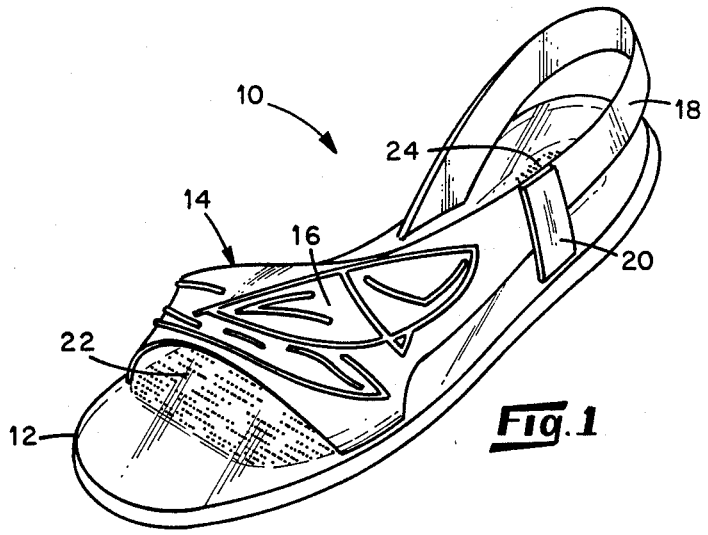
FIG. 1 is a perspective view of a plastic shoe having a transparent sole with opaque scuff pads.

Referring now to the drawings in which like reference characters designate like or corresponding parts throughout the several views, there is shown in FIG. 1 a perspective view of a plastic shoe 10 embodying one form of the present invention. The shoe 10 includes a transparent plastic sole 12 and a plastic upper 14 to secure the shoe to a human foot. The shoe is constructed of a soft, flexible plastic in its entirety, and the sole 12 is constructed primarily of a flexible transparent plastic. The shoe upper 14 includes an instep strap 16 that extends across the top front part of the shoe 10 and is designed to secure the shoe over the instep of a human foot. A heel strap 18 extends rearwardely from the instep strap 14 and is designed to encircle the heel of a human foot when the shoe is worn. A downward strap 20 is secured between the sole 12 and the heel strap 18 for the purpose of anchoring the heel strap and improving the ability of the shoe to remain on the human foot. A design 16 is embossed on the instep strap and the heel strap 18 for the purpose of decoration only.

In the view shown in FIG. 1, scuff pads 22 and 24 are visible through the sole 12 of the shoe. The scuff pad 22 is located in the ball area of the sole 12 and pad 24 is located in the heel area of the sole 12. These two areas are the primary regions of the sole 12 that are scuffed during walking. As previously mentioned scuffing the ball or heel area of a transparent sole 12 decreases the aesthetic appeal of the shoe and, in order to overcome this deficiency, the scuff pads 22 and 24 are constructed of an opaque plastic. Thus, while the pads 22 and 24 will be scuffed, the scuffing will not be visible from the top side of the sole 12 and the sole 12 will remain clear in appearance. The clear appearance will suggest cleanliness and newness which is aesthetically appealing to the wearer. Also, even when viewed from the bottom side, the scuff pads 22 and 24 will appear less scuffed. Scuffing on the clear sole 12 will create a frosted or scratched appearance which is easily visible and magnifies the scuffed appearance. Thus, by providing the scuff pads 22 and 24 the shoe will retain its pleasing appearance for a greater length of time.

Figure 2:
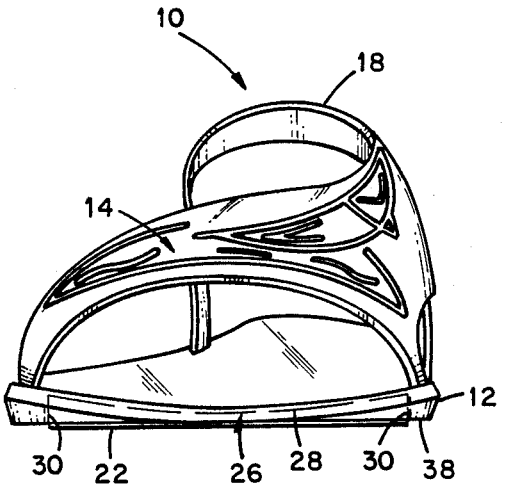
FIG. 2 is a front view of the shoe shown in FIG. 1 in which the opaque insert is shown extending downwardly from the lower surface of the sole.
Figure 3:
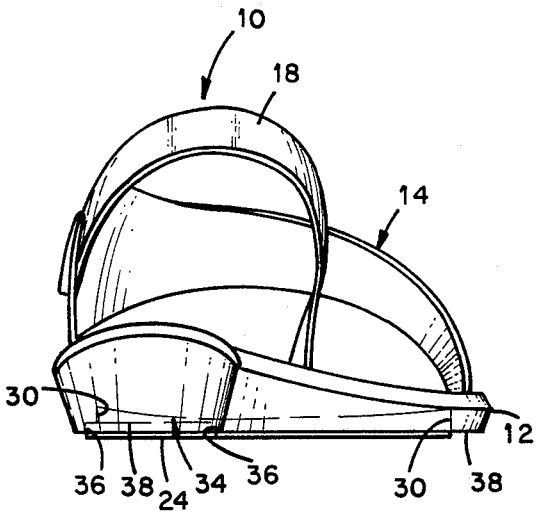
FIG. 3 is a back view of the shoe.
Figure 4:
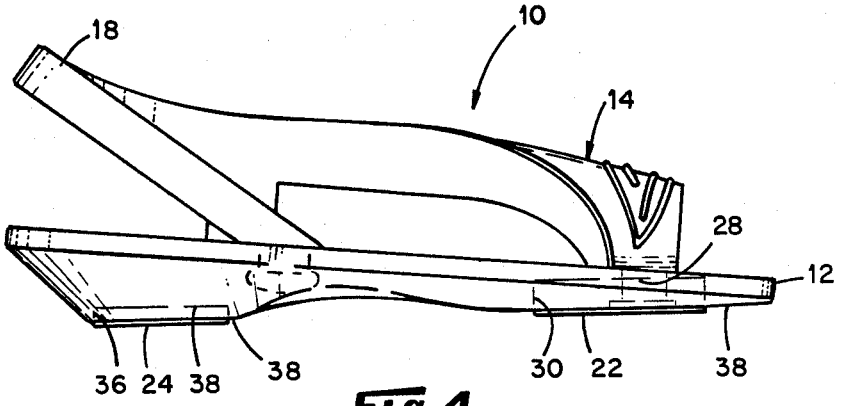
FIGS. 4 and 5 are side views of the shoe.
Figure 5:
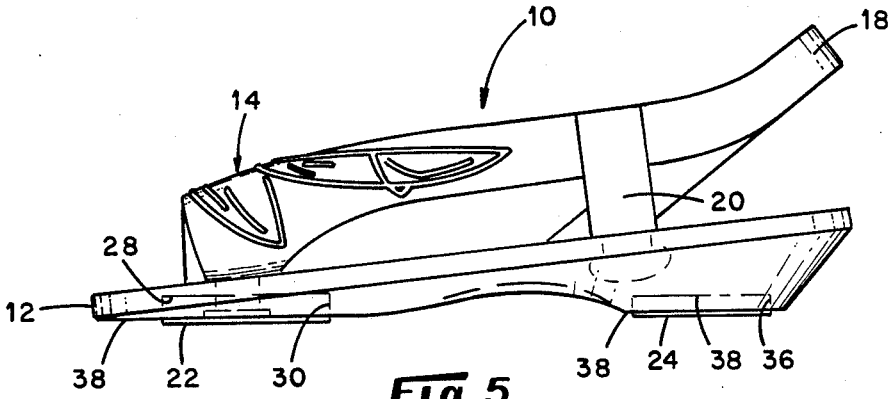

As shown in FIGS. 2 and 3, which are front and rear views of the shoe 10, respectively, the scuff pads 22 and 24 are mounted in recesses 26 and 32, respectively, of the sole 12. The recess 26 is bounded by side walls 30 and includes a substantially horizontal main surface 26. The insert 22 is bonded to the main horizontal surface 28 of the recess 26, preferably by forming the sole 12 over the scuff pad 22. By reference to FIG. 3, it will be appreciated that the heel scuff pad 24 is mounted in recess 34 which is defined by side walls 36 and includes a substantially horizontal main recess surface 38 to which the pad 24 is bonded. Both pads 22 and 24 extend downwardy beyond the lower surface 38 of the sole 12 to provide additional scuff protection. The extension of the scuff pads 22 and 24 below the lower surface 38 of the transparent sole 12 is perhaps best shown in FIGS. 4 and 5 which are side views of the shoe 10.

Figure 6:
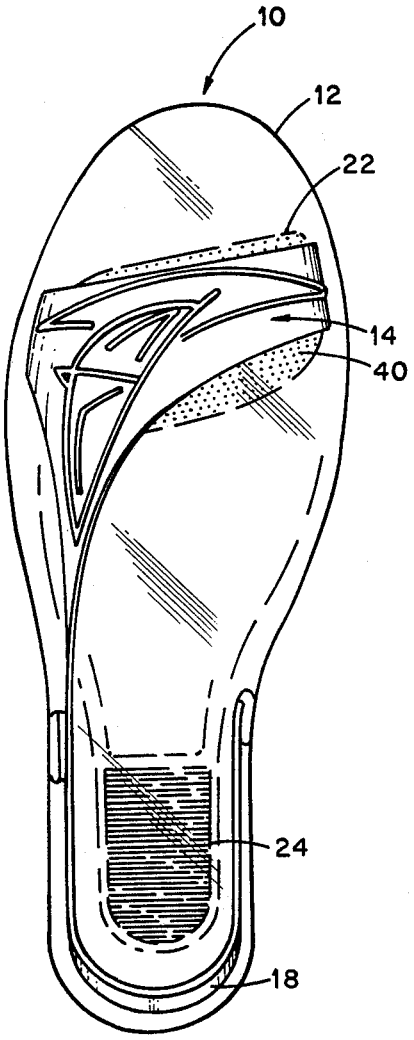
FIG. 6 is a top view of the shoe.
Figure 7:
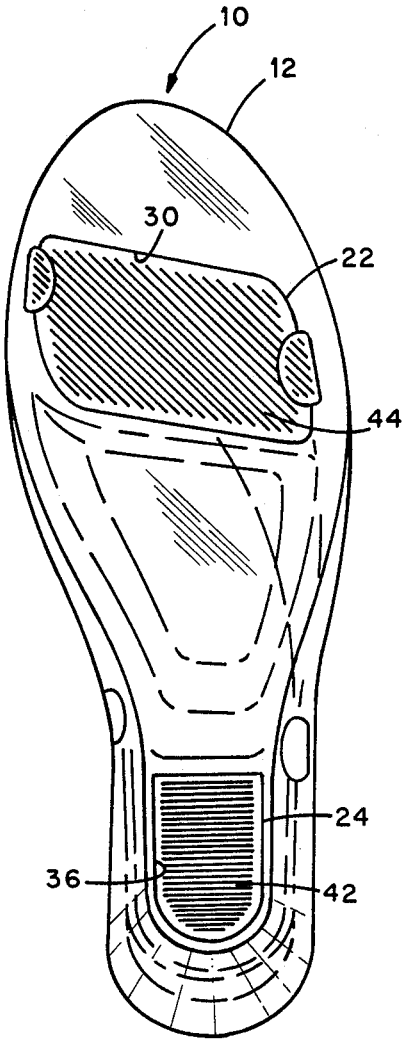
FIG. 7 is a bottom view of the shoe.

FIGS. 6 and 7 show, respectively, top and bottom views of the shoe 10, and these views best depict the shape and appearance of the pads 24 and 22. As shown in FIG. 6, the pad 24 has a ridged appearance from the top of the shoe, and the pad 22 has a smooth appearance. A raised dot pattern 40 is formed on the upper surface of sole 12 over the pad 22, but the pad itself appears smooth below the dot pattern 40.

Referring to FIG. 7, the bottom of the sole 12 is shown. In this view, it may be appreciated that the pad 24 has a ridged bottom 42 with the ridges running substantially perpendicular to the longitudinal axis of the shoe. The pad 22 includes raised ridges 44 with the ridges 44 inclined at an angle of approximately forty-five degrees with respect to the longitudinal axis of the sole 12. The ridges 44 and 42 formed on the pads 22 and 24 provide traction for the shoe, but more importantly, the ridges will disguise or obscure scuffing as the shoe is worn. Thus, when viewed from the bottom or the top, scuffs are obscured. If the pads 22 and 24 were not present, and the transparent sole 12 was exposed to scuffing, a frosted and scratched appearance would very quickly develop on the bottom of the sole 12. Thus, the pads 22 and 24 provide a pleasing aesthetic appearance and increase the life of the aesthetic appearance of the shoes 10.

Although a particular embodiment has been shown in the foregoing Detailed Description, it will be appreciated that the invention is capable of various modifications, alterations and substitutions of parts and materials without departing from the scope of the invention as defined by the appended claims.

What is claimed is:

1. A plastic shoe for being worn on a human foot comprising:

a transparent plastic sole having a lower surface and an upper surface for fitting against the sole of a human foot, said upper and lower surfaces being visible from above and below said sole due to its transparency, and said sole having a heel area for being disposed adjacent the heel of the foot and a ball area for being disposed adjacent the ball of the foot;

an upper for securing the transparent sole to the foot; and at least one opaque scuff pad disposed on the lower surface of said transparent sole at least in said ball area of said sole, said pad being visible from above the shoe through the upper surface of the sole, said pad being positioned in an area of said sole typically subject to a high degree of scuffing so that said scuff pad receives scuffing in said area instead of the lower surface of the sole, which scuffing is not visible from above the sole due to the opaqueness of the pad, and being dimensioned to extend over only a portion of said lower surface so that a substantial portion of said lower surface remains uncovered and is, therefore, visible from above said sole.

2. The plastic shoe of claim 1 further comprising:

a recess formed in the lower surface of said transparent sole and shaped to receive said opaque scuff pad, said recess having a main surface and having side walls extending about said main surface;

means for mounting said opaque scuff pad in said recess on said main surface; and said scuff pad being dimensioned to extend from said main surface of said recess outwardly beyond said side walls and the lower surface of said transparent sole to absorb scuffing when the sole is walked upon.

3. The plastic shoe of claim 1 further comprising an opaque scuff pad disposed on said lower surface of said transparent sole in the heel area of said transparent sole.

* * * * *